US008894551B2

(12) United States Patent
Kerdjoudj

(10) Patent No.: US 8,894,551 B2
(45) Date of Patent: Nov. 25, 2014

(54) PORTABLE EXERCISE MACHINE FOR LOWER BODY

(75) Inventor: Mohamed Kerdjoudj, Aurora, IL (US)

(73) Assignee: Mohamed Kerdjoudj, Aurora, IL (US)

( * ) Notice: Subject to any disclaimer, the term of this patent is extended or adjusted under 35 U.S.C. 154(b) by 300 days.

(21) Appl. No.: 13/417,378

(22) Filed: Mar. 12, 2012

(65) Prior Publication Data

US 2013/0237393 A1 Sep. 12, 2013

(51) Int. Cl.
*A63B 21/00* (2006.01)

(52) U.S. Cl.
USPC ..... 482/70; 482/71; 482/74

(58) Field of Classification Search
USPC ..... 482/68, 72, 126, 121, 69
See application file for complete search history.

(56) References Cited

U.S. PATENT DOCUMENTS

| | | | | |
|---|---|---|---|---|
| 4,529,194 | A | 7/1985 | Haaheim | |
| 4,618,139 | A | 10/1986 | Haaheim | |
| 4,948,121 | A | 8/1990 | Haaheim | |
| 5,044,355 | A | 9/1991 | Reopelle | |
| 5,108,092 | A | 4/1992 | Hurst | |
| 5,279,530 | A | 1/1994 | Hess | |
| 5,499,958 | A | 3/1996 | Hess | |
| 5,575,740 | A | 11/1996 | Piaget | |
| 5,855,538 | A | 1/1999 | Argabright | |
| 6,042,523 | A * | 3/2000 | Graham | 482/121 |
| 6,176,814 | B1 | 1/2001 | Ryan et al. | |
| 6,338,704 | B1 | 1/2002 | Endelman | |
| 6,709,368 | B1 | 3/2004 | Chue | |
| 7,134,987 | B2 | 11/2006 | Goldstein | |
| 2001/0036885 | A1 | 11/2001 | Castellot | |
| 2005/0054492 | A1 | 3/2005 | Neff | |
| 2005/0250621 | A1 * | 11/2005 | Corbalis et al. | 482/52 |
| 2007/0155600 | A1 * | 7/2007 | Cunningham et al. | 482/126 |
| 2009/0098983 | A1 * | 4/2009 | Hoffman | 482/70 |
| 2011/0183814 | A1 | 7/2011 | Raumann | |
| 2011/0221161 | A1 * | 9/2011 | Ludovici et al. | 280/250.1 |

FOREIGN PATENT DOCUMENTS

| | | | |
|---|---|---|---|
| SU | 1674877 | A | 9/1991 |
| WO | WO 2009/075493 | A | 6/2009 |

* cited by examiner

*Primary Examiner* — Jerome w Donnelly

(57) ABSTRACT

An exercise device comprising a foot carriage slideably mounted on tracks, the tracks are held together parallel to one another and resistance elements provide opposition against the relative motion of the foot carriage. The foot carriage can be a frame carrying wheels and a foot support.

36 Claims, 25 Drawing Sheets

PORTABLE EXERCISE MACHINE FOR LOWER BODY

CROSS-REFERENCE TO RELATED APPLICATIONS

This application claims benefit of Provisional Application Ser. No. 61/572,331, hereby incorporated by reference.

BACKGROUND OF THE INVENTION

1. Field of the Invention

This invention relates to exercise devices, specifically to devices that can be placed under a desk or near a sofa for exercise of the lower body from a sitting position. This device can be used while working, watching TV or involved in other activities.

2. Background of the Invention

Today, people spend a lot of time sitting in front of computer terminals, sitting in libraries and classrooms, and sitting in front of the television without doing any type of exercise to stimulate their muscles. Furthermore, office work can be very stressful to people who have no time for exercise. During sitting, the body is in a stationary position for a long time without any movements. This physical inactivity of the body may lead to certain kinds of health problems such as muscle aches, pains and circulatory problems in the legs. One of the factors that contribute to the obesity is the lack of exercise. Therefore, it is recommended that individuals should avoid sitting for a long period of time without doing any kind of exercise activity. Furthermore, it is recognized that the best activities for the heart are those that use the large muscles of the body, particularly those in the legs, making them demand more oxygen to do their work. The activities that involve repetitive motion for an extended period of time are effective for cardiovascular health.

Therefore, inventors have created several inventions for exercise machines that simulate various indoor and outdoor sport activities. U.S. Pat. No. 6,709,368 discloses a portable device that simulates walking, while sitting down. The device consists of two pedals that move in opposition to one another. A dial located between the two pedals controls a mechanism that provides resistance to the rise and fall of the pedals. The drawback is that the movement is constrained to the feet pivoting about the ankles, thereby, not providing exercise to the whole leg. The spread between right and left pedals is non adjustable.

U.S. Pat. No. 5,855,538 discloses a device that allows the user to extend each leg separately from a sitting position. The device consists of a pair of foot plates that move forward and rearward along upwardly curved tracks attached to horizontal and vertical support bases. Resistance to the movement can be provided by the use of hydraulic cylinders or straps. However, the device lacks simplicity and easiness of use.

U.S. Pat. No. 5,499,958 discloses a portable leg exercising apparatus for lower back rehabilitation. This device is limited to users who are lying on their back either in a horizontal or reclined position and pushing a pair of pedals along inclined guide ways supported by V shaped frame.

U.S. Patent application publication No. US 2009/0098983 discloses a exercise device having two independent tracks with a physical connection between them, and movable platform on each track.

U.S. Patent application publication No. US 2001/0036885 discloses a leg exercise device comprising a base member having at least one track which allows a foot pad to travel within. The foot pad has gliders to glide on the tracks and the sides of the foot pad rub against the track edges to keep it moving straight. This can potentially result into friction, heat and noise generation. The foot pad comprises rollers mounted within cavities of the bottom surface of the foot pad to roll along the track. This can results in roller misalignments, skidding, wear and can potentially cause rough riding and noise.

U.S. Pat. No. 5,108,092 discloses a portable exercise device having a rotatable pedal mounted on an arm that is pivotally connected to a base. The device can be operated from an independent seat free of any connection. A flywheel can be integrated to the device to provide momentum to pedal movement. However, the device can be heavy and the movement of the user's knees can interfere with a desk if the device is placed underneath it.

U.S. Pat. No. 4,948,121 discloses a device for aerobic conditioning and having a frame assembly with rails. The device contains a pair of foot skates with rollers movably mounted on the rails and a pair of arm poles attached to the frame assembly. The shortcomings of this device are bulkiness, lack of portability and limited degree of safety and comfort. A great number of devices have been invented to simulate cross-country skiing or some other similar exercises such as U.S. Pat. Nos. 4,743,015, 4,684,121, 4,434,981, 4,402,506, 5,044,355, 5,575,740; however, these devices suffer from various disadvantages such lack of portability, lack of safety, lack of smoothness and simplicity.

SUMMARY OF THE INVENTION

The exercise device of the present invention comprises a foot carriage constrained to roll in a forward and backward motion. The foot carriage is slideably mounted within tracks and comprises a foot support for receiving a user's foot and a frame for providing a rigid structure that carries wheels. The device further comprises resistance means releasably secured between the foot carriage and end caps attached to the ends of the tracks.

The present invention features a unique portable device for exercise by moving the foot in a forward and a backward motion from a seated position. Therefore, the user is able to exercise the lower body while working or being involved in some type of activities. The user has the option of using one device for one foot or of using two devices for both feet.

The present disclosure relates to an exercise device comprising a foot carriage slideably mounted within tracks and means to provide resistance to the foot carriage motion. The foot carriage comprises a plurality of wheels, a frame and a foot support.

DETAILED DESCRIPTION OF THE INVENTION

Figure 1:
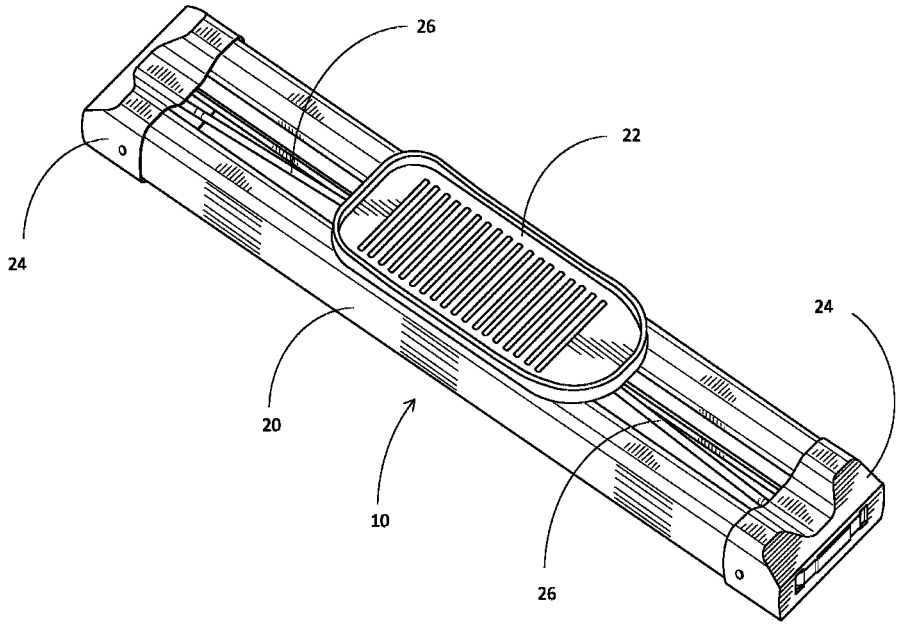
FIG. 1 is a top perspective of one embodiment of the portable exercise device.

While the present disclosure may be susceptible to embodiment in different forms, there is shown in the drawings, and herein will be described in detail, an embodiment with the understanding that the present description is to be considered an exemplification of the principles of the disclosure and is not intended to limit the disclosure to the details of construction and arrangements of components set forth in the following description or illustrated in the drawing.

Figure 2:
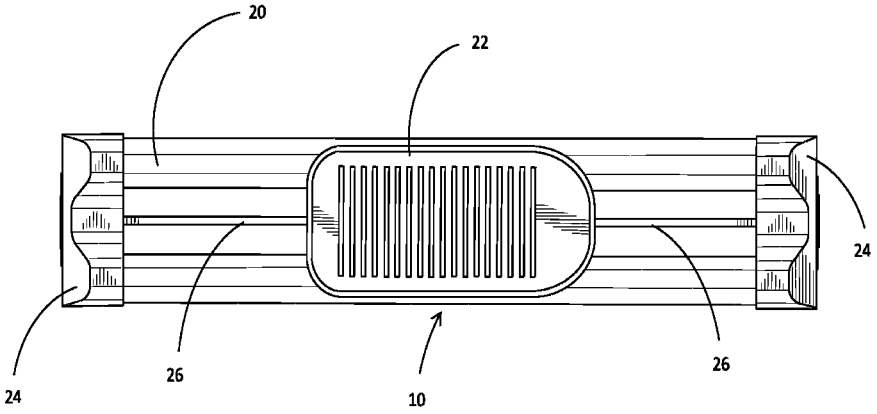
FIG. 2 is a top view of one embodiment of the portable exercise device.
Figure 3:
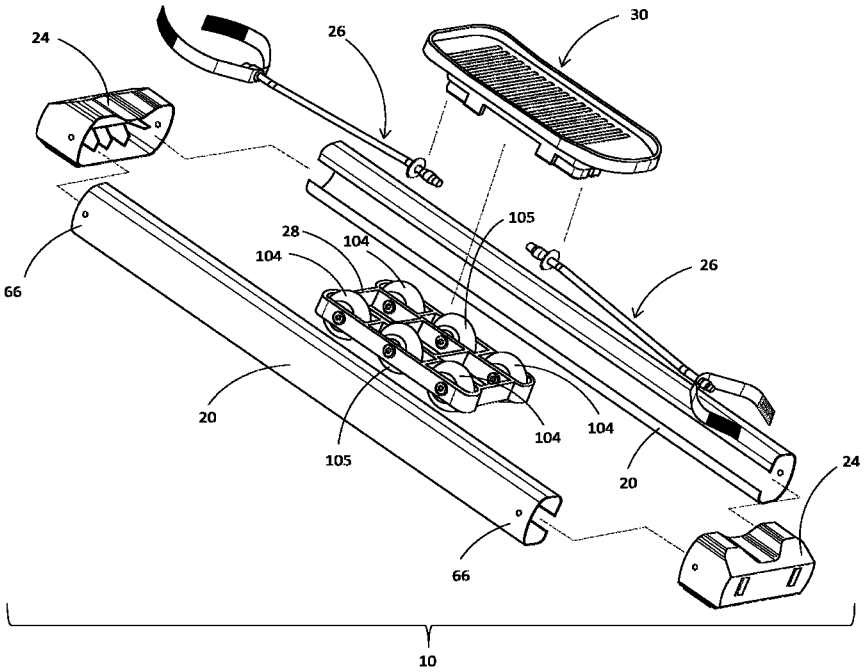
FIG. 3 is an exploded view of one embodiment of the portable exercise device.

A preferred embodiment of the exercise device 10 of the present invention is illustrated in FIGS. 1, 2 and 3. The device 10 comprises tracks 20, a foot carriage 22 slideably mounted within the tracks 20, a pair of end caps 24 fastened at the ends of tracks 20, a plurality of resistance elements 26 releasably attached between the foot carriage 22 and the end caps 24, and a plurality of wheels 104, 105 mounted to the foot carriage. In one embodiment, one end of a first resistance element is releasably attached to a first end cap while the second end of the first resistance element is releasably attached to a first end of the foot carriage while, similarly, one end of a second resistance element is releasably attached to a second end cap while the second end of the second resistance element is releasably attached to the second end of the foot carriage where the first end of the foot carriage is in proximity to the first end cap and the second end of the foot carriage is in proximity to the second end cap. The resistance element 26 that provides resistance to the forward and backward motions of the foot carriage 22 can be easily attached to and removed from the device. The resistance element 26 may have any suitable construction and dimensions or maybe any commercially available rubber resistance tube.

Figure 12:
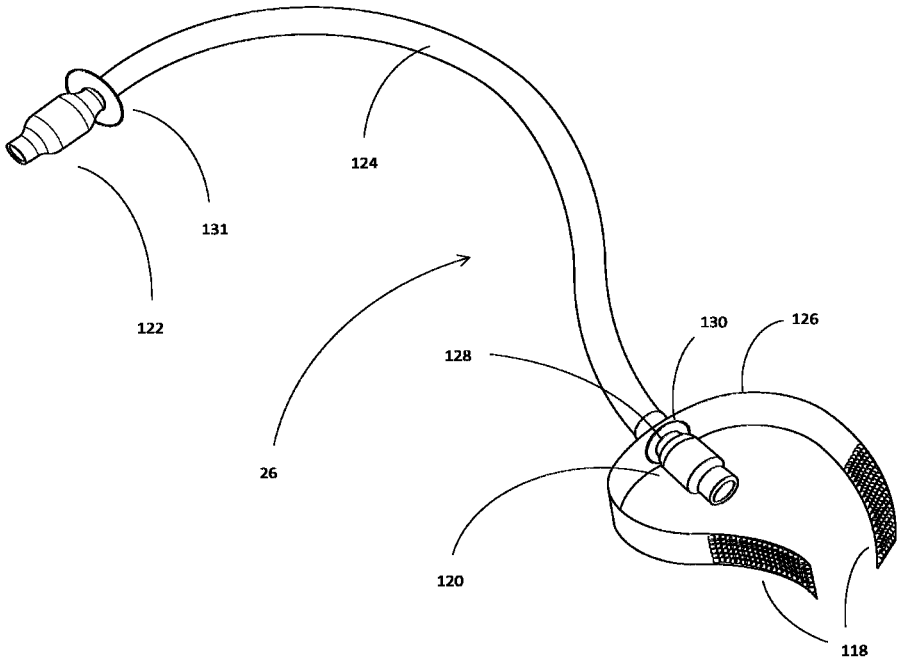
FIG. 12 is a perspective view of one embodiment of the resistance element.

As shown in FIG. 12, the resistance element has elastic tubes 124 which has two ends 120 and 122 which can be releasably secured between the end cap 24 and foot carriage 22 respectively. The length of the tracks 20 is sufficient to accommodate the span of a user's leg swinging in a forward and backward motion. End caps 24 hold tracks 20 together and roughly parallel to one another and provide structural integrity. The tracks 20 and end caps 24 suitably enclose the foot carriage 22, thereby keeping the foot carriage 22 confined to move along tracks 20 and between the end caps 24. The tracks 20 may consist of a plurality of pieces or a single integral piece as suitably made from extruded aluminum or molded plastics.

Figure 7:
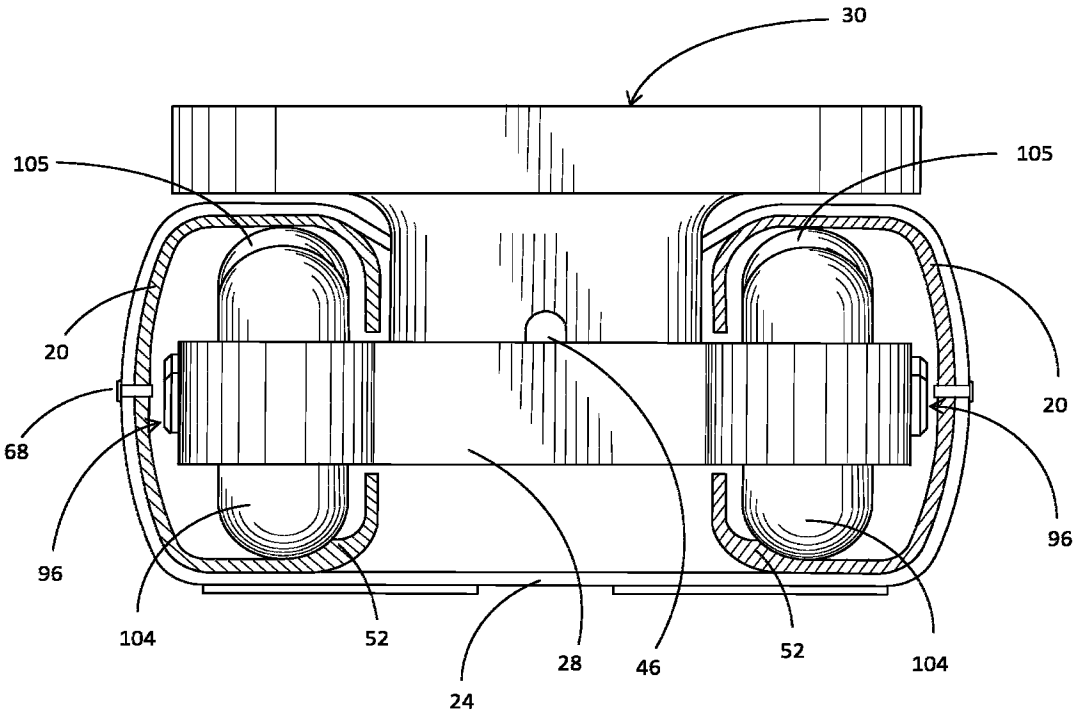
FIG. 7 is a front or rear view of one embodiment of the housing with the end cap removed.

As shown in FIG. 7, the tracks 20 define a channel where the interior of the channel has an upper and a lower surface. The wheels rest within the channel defined by the tracks. The lower surface of the interior of the channel may include longitudinal ridges 52 which can be used as guides for wheels 104.

Figure 4:
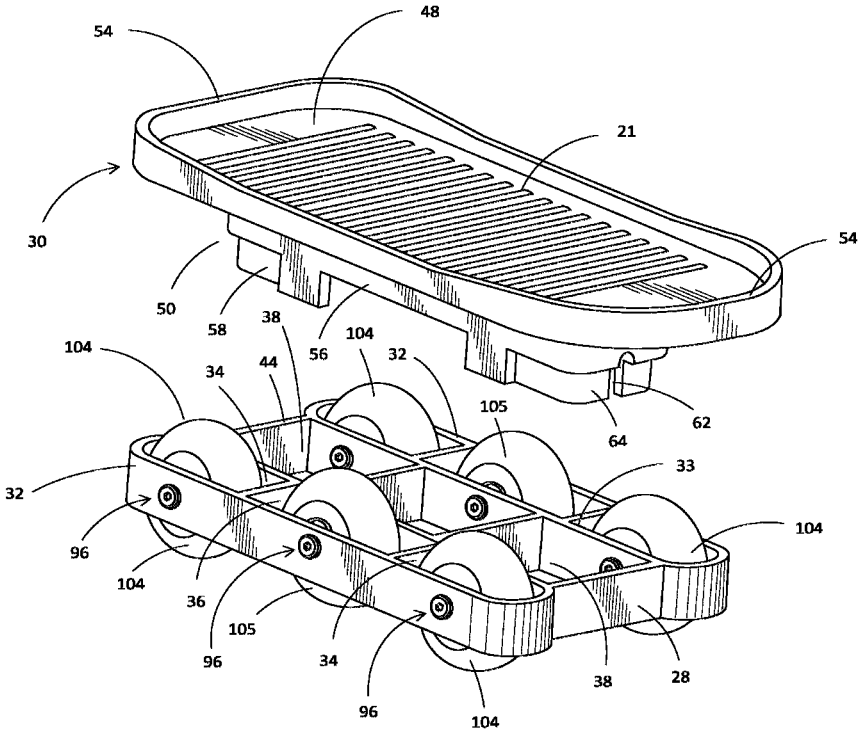
FIG. 4 is an exploded view of the foot carriage.
Figure 5:
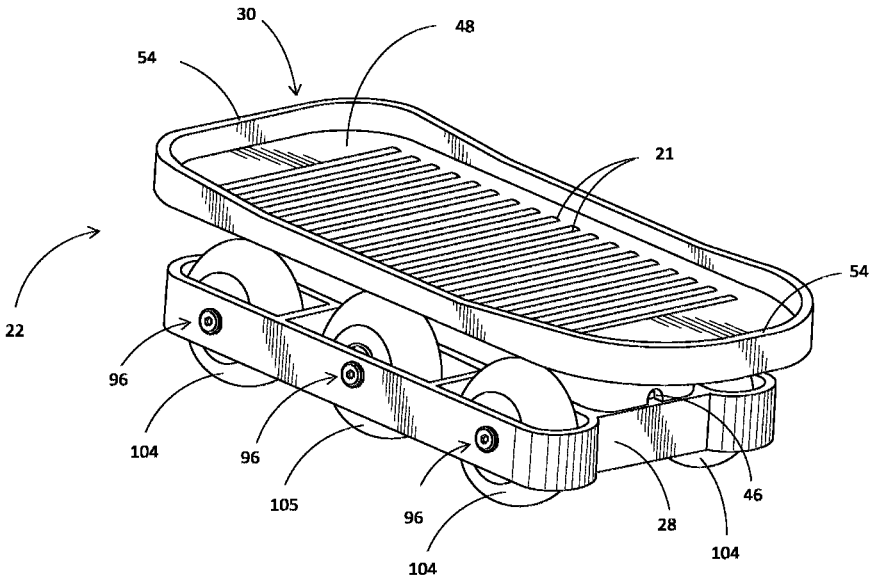
FIG. 5 is a top perspective of the foot carriage.
Figure 6:
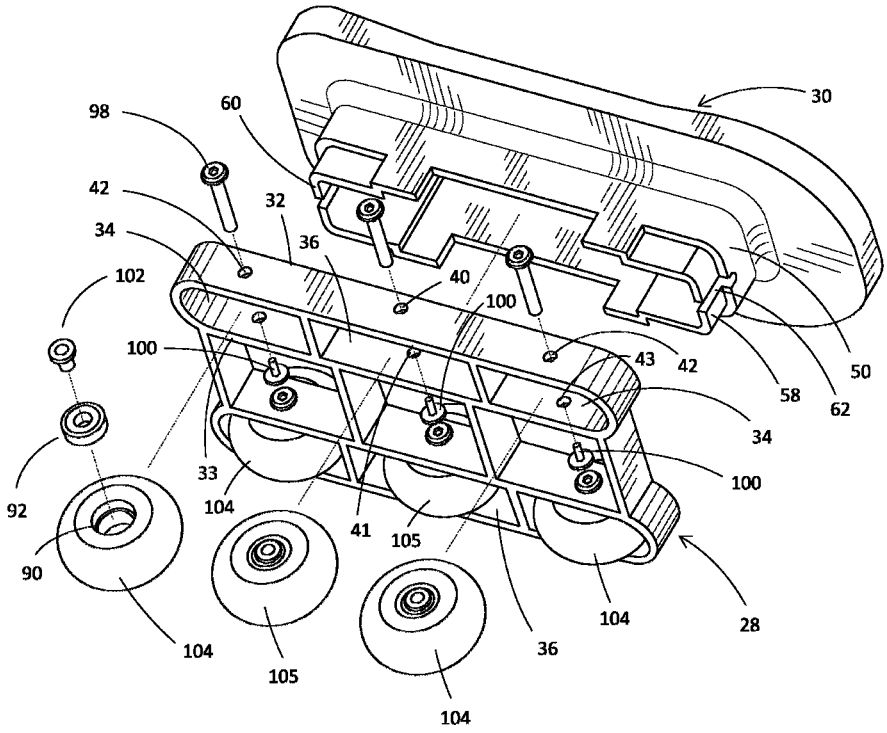
FIG. 6 is an exploded view of the foot carriage.

Referring to FIGS. 4, 5 and 6, the foot carriage 22 include a frame 28, a foot support 30 and a plurality of wheels 104, 105 mounted on axle means 96 that will be described in detail hereafter. In one embodiment, the frame 28 is a one-piece molded polymeric/co-polymeric (rigid or semi-rigid materials) construction or extruded aluminum. The frame, shown generally at 28, is an integral body consisting of an upright wall of a relatively rectangular configuration as defined by the periphery 32 that encloses a plurality of rows of walls in the longitudinal direction and a plurality of rows of walls in transversal direction, thereby forming a substructure that provides substantial rigidity to support the axles 96 which carry the wheels 104 and 105. The frame comprises a plurality of apertures 34 and 36 into which substantially identical wheels 104 and 105 are received. In the embodiment shown, each of the wheel apertures 34, 36 is in the form of a wide slot. The middle wheel apertures 36 are positioned between the end wheel apertures 34. The end wheel apertures 34 are positioned at the ends of frame 28 and include aligned axle bores 42, 43 generally confronting one another and coaxial with wheel axle 96; and each middle aperture 36 includes the axle bores 40 and 41 for carrying wheel axles 96. The axle bores 40 and 42 are positioned on the side panel 32 of the periphery and the bores 41 and 43 are positioned on the internal wall 33. In the embodiment shown, the frame 28 comprises a plurality of center apertures 38 sandwiched between wheel apertures. These center apertures 38 engage with bottom portion 50 of foot support 30. Those skilled in the art will see that other methods of attachment between the frame and the foot support are possible, or that the frame and the foot support can be on integral piece.

The wheels 104, 105 are rotatably mounted and centered between the two parallel walls 32, 33 of the wheel apertures 34, 36. Each left and right group of wheels 104, 105 are mounted for rotation in a common plane.

Figure 8:
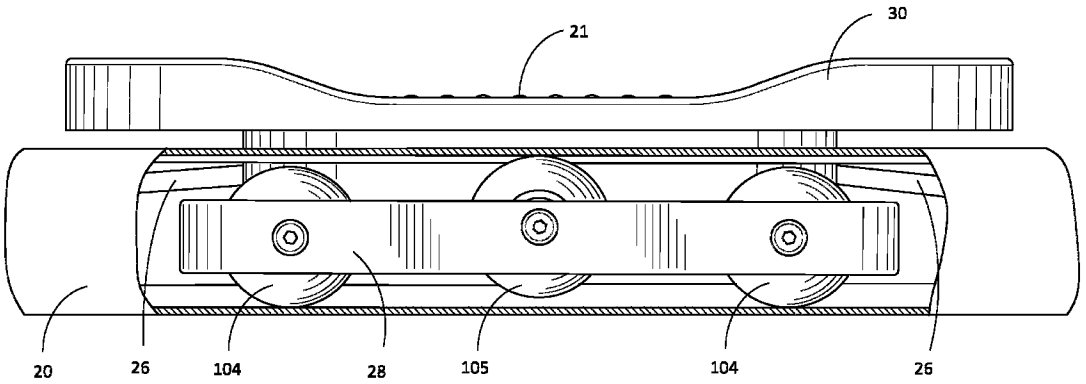
FIG. 8 is a side view with cut out in tracks illustrating the foot carriage.

Referring to FIGS. 6 and 8, four wheels 104 supporting the carriage are mounted inside the end wheel apertures 34 and the wheels 105 in rolling contact with the upper surfaces of the interior of the channels defined by the tracks 20 are mounted inside the middle wheel apertures 36. The middle axle bores 40, 41 are offset upward from the horizontal common plane passing through the axle bores 42, 43 of the end wheels apertures, thereby permitting the center wheels to come in rolling contact with only the top surface of the tracks 20.

Referring to FIGS. 4, 5, and 6, a foot support member shown generally at 30 is one-piece rigid or semi-rigid materials construction composed of two portions: a top flat portion 48 which receives the user's foot and a bottom portion 50 which engages with the frame 28. In an alternative embodiment, the foot support may be connected to the frame in one integral piece. The flat portion 48 may include on its top surface a plurality of transversal and small size ridges 21 that help the foot to grip on the top surface of the foot support 30 during exercise. The flat portion may include raised walls 54 at the heel and toe ends that keep the foot centered on the foot support surface. In the embodiment shown, the bottom portion 50 of the foot support 30 comprises a wall of a relatively rectangular configuration as defined by the periphery 56 and engaging portions 58 positioned at the ends of the longitudinal side of the periphery 56. The periphery wall has a suitable thickness and top land surface 60 which comes in contact with the top surface 44 of the frame 28 during engagement. Each engaging portion 58 is a wall structure in the form of three sides of a square, with rounded corners, and internal to the periphery 56. Each of the ends of the rectangular periphery has a downward extending notch 62. The internal surface of the center apertures 38 of the frame 28 comes in contact with the external surface of the engaging portions 58 of the foot support and can easily slide together into and out of engagement.

Referring to FIG. 5, in one embodiment, when the foot support 30 engages with the frame 28, the downward extending notch 62 combines with the frame to form an opening 46 on either end of the foot support, creating a passage through which one of the elastic tubes 124 can pass.

Figure 14:
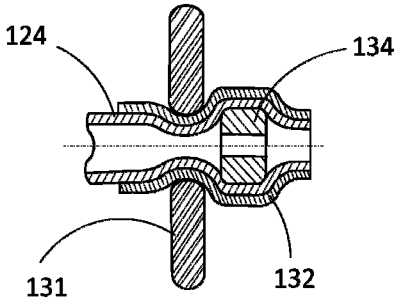
FIG. 14 is a sectional view illustrating the plug, sleeve and washer.

Referring to FIGS. 12 and 14, a washer 131 is inserted around the second end 122 of the elastic tube 124, and a plug 134 is inserted into the second end of the elastic tube between the location of the washer 131 and the terminus of the elastic tube. The width of the opening 46 is smaller than the outside diameter of the washer 131. The user's foot pressure keeps the foot support and the frame engaged with each other, thereby helping to hold the washer and the second end of the elastic tube 124 in place. When the foot carriage is in motion during the exercise, the elastic tube 124 is stretched under the pull action of the user's foot moving the foot carriage. The opening 46 blocks the washer 131 which is prevented by the plug 134 from disengaging from the elastic tube 124.

Figure 10:
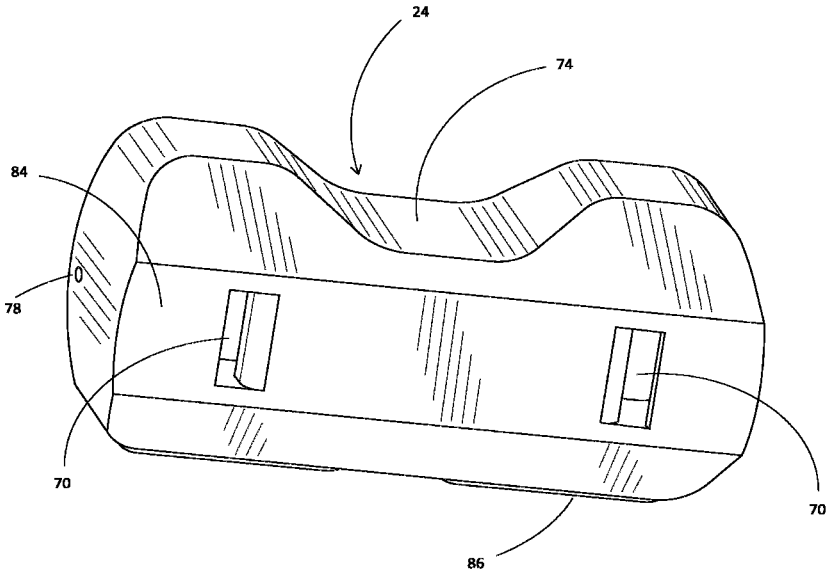
FIG. 10 is a top perspective of external view of one embodiment of the end cap.
Figure 11:
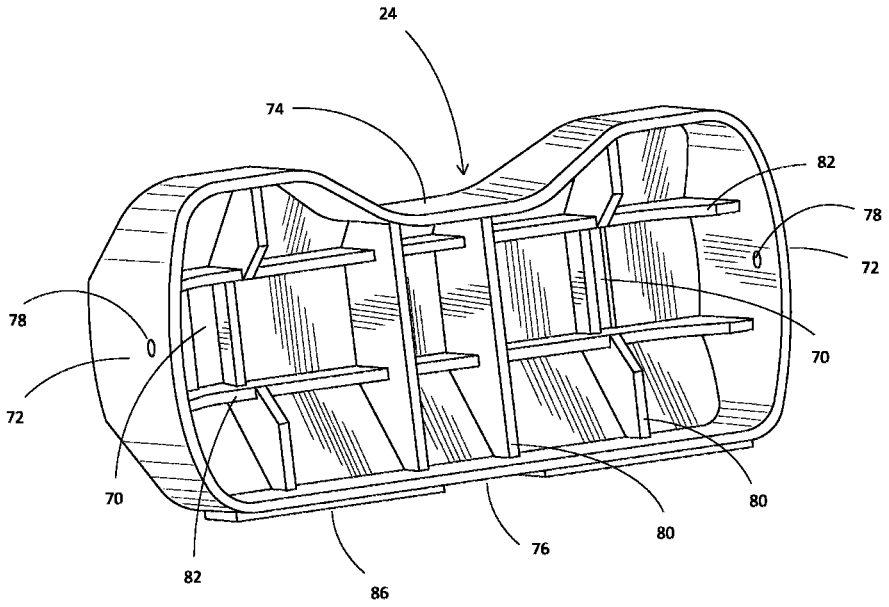
FIG. 11 is a top perspective of internal view of one embodiment of the end cap.

Referring now to FIGS. 3, 10 and 11, an end cap 24 can be attached to each end 66 of the tracks. Any appropriate method of attachment may be used, such as screws, bolts, or rivets. The end cap 24 can be made with tough durable plastic or any strong material to be able to provide structural integrity to the device and provide means of releasably securing the resistance element 26 at the ends 66 of tracks 20. The side, bottom and top panels of the end cap 72, 76, 74 respectively are wrapped around the ends 66 of the tracks 20. The end cap can be fastened by means of a plurality of screws 68 or other means of attachment which are received through bores 78. In one embodiment, the inside of the end cap 24 housing contains a plurality of ribs 80, 82 to provide stiffness to the housing during exercise when the elastic tubes are stretching, although other embodiments may not contain ribs The front panel 84 has a multiplicity of slots 70 which extend through the end cap material for passage of the ends of strip 126. Pieces of non-slip material 86 may be coated or attached by means of an adhesive to the portion of the bottom panel 76 that will rest on the ground so that during exercise the device stays stationary on the ground.

Figure 9:
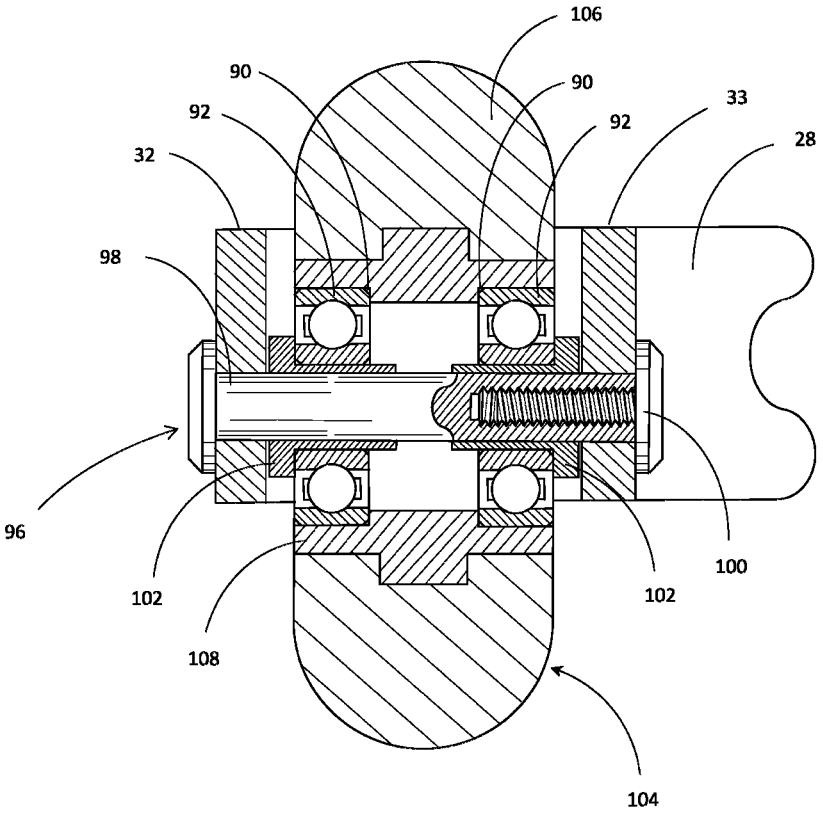
FIG. 9 is a sectional view illustrating the wheel, bearings, axle and flange sleeve.

Because of the identical nature of the wheel mounting components, only those associated with wheel 104 will be described in detail. Although a variety of different types of wheels can be used, referring now to FIG. 9, in the preferred embodiment, the wheels 104, 105 known are as recreational or in-line wheels and are available from a variety of suppliers. These wheels are used in applications such as in-line roller skates. An example of such an application is provided in U.S. Pat. No. 5,028,058. The wheel 104, 105 has an outer tire member 106 formed of an annulus of a resilient material such as urethane which is molded about and closely encapsulates the outer portion of a hub 108, which rotates about the central axis of the wheel. The urethane material provides smooth and quiet operation of the wheel. The hub 108 is molded of rigid plastic material and it is an integral body of two concentric rings. The inner ring is may be of greater width than the outer ring and extends fully between the sides of the wheel. As shown in FIGS. 6, 9, the inner ring of the hub 108 has left and right bearing apertures 90 into which substantially identical left and right bearings 92 are received and frictionally retained. Those with skill in the art will see that there are other methods of mounting the wheels to the foot carriage. In the embodiment shown, each wheel is mounted on a pair of bearings 92. In one embodiment, the bearings are a miniature precision stainless ball type for low-friction application; they are shielded bearings by means of steel shields that help keep out dirt, although other types of bearings and wheels can be used. The bearings 92 are kept apart from each other by means of a central shoulder of the hub 108 of the wheel abutting against the outer races of the bearings.

FIG. 9 shows a conventional way for mounting the in-line wheels 104, 105 between the walls 32 and 33. The axle 96 consists of an internally threaded cap barrel 98 receiving a cooperating threaded cap screw 100, extends through the walls 32 and 33. Spacers 102 and bearings 92 are installed on the axle on both sides of the wheel. The cap barrel 98 and cap screw 100 provide collectively a clamping means on the axle by which the spacer 102 and the inner race of the bearing 92 may be tightly retained on the walls 32 and 33 of frame 28. The outer race of the bearing 92 then rotates freely about the axle to permit easy and fast rotation of the wheel.

While FIG. 9 is shown for purposes of describing the present invention, it will be understood that a variety of methods for mounting the wheels can be used, including mounting methods that allow vertical adjustments of the axis of rotation of wheels.

Referring now to FIGS. 10 and 12, in different embodiments, the elastic tube 124 can be secured to the end cap 24 by any suitable method. One method is to have a strip 126 with two ends connected to the elastic tube 124 and attaching the strip 126 to the end cap 24 by passing the first end of the strip through one of the slots 70 in the end cap 24 and passing the second end of the strip through the other slot 70 in the end cap 24 and then connecting the first end of the strip to the second end of the strip. The elastic tube 124 may be secured to the strip 126 by any suitable method. An example of a method is provided in U.S. Pat. No. 5,800,322.

Figure 13:
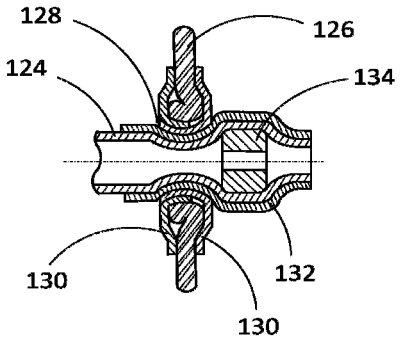
FIG. 13 is a sectional view illustrating the plug, sleeve and grommet.

FIGS. 12 and 13 illustrate the preferred embodiment which comprises a strip 126 which defines a hole 128 located in the middle of the strip 126 through which the elastic tube 26 passes, a metal grommet 130 disposed about the hole. A sleeve 132 may be disposed at the end 120 of the elastic tube 124. A plug 134 made of plastic or the like may be disposed within the elastic tube 124 adjacent to its end. The plug 134 is received snugly within the channel defined by the elastic tube adjacent to the open end of the elastic tube and is configured to expand the channel and the portion of the elastic tube 124 and sleeve 132 disposed about the plug 134. As a result, the plug prevents the strip from disengaging from the elastic tube by blocking the strip from moving past the plug. The sleeve 132 can be located so that it covers, at minimum, the area between the grommet 130 and the elastic tube 124, thereby protecting the tube from direct contact with the grommet 130. Thus, as the elastic tube 124 is stretched back and forth, the elastic tube rubs against the sleeve 132 rather than the grommet, thereby reducing the likelihood of breakage and extending the life of the elastic tube.

The first and second ends of the strip may be releasably securable in any suitable methods, such as, for example Velcro™ band (hook and loop fasteners), buckles, clips, etc. In the illustrated embodiment, for example, hook and loop fasteners 118 are attached to the first and second ends of the fabric strip for securing the strip to the end cap in the manner discussed previously. The strip 126 can be made of fabric or any other suitable material, may have any suitable construction or configuration, and may be secured to end cap 24 in any suitable manner and at any suitable location.

Figure 15:
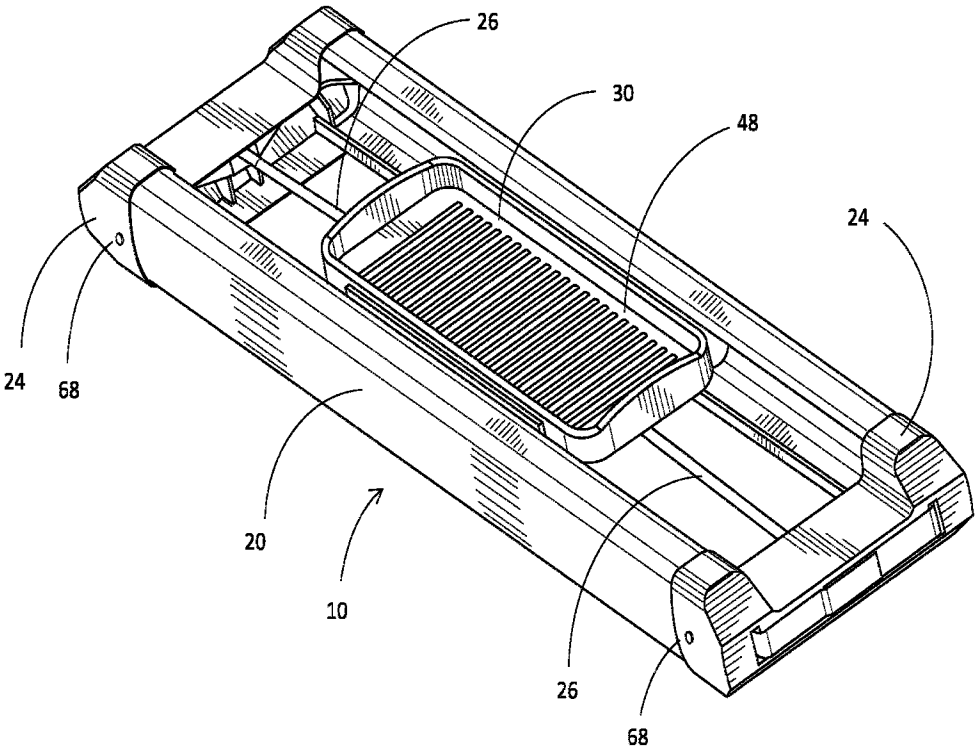
FIG. 15 is a top perspective view of a second embodiment of the portable exercise device.
Figure 16:
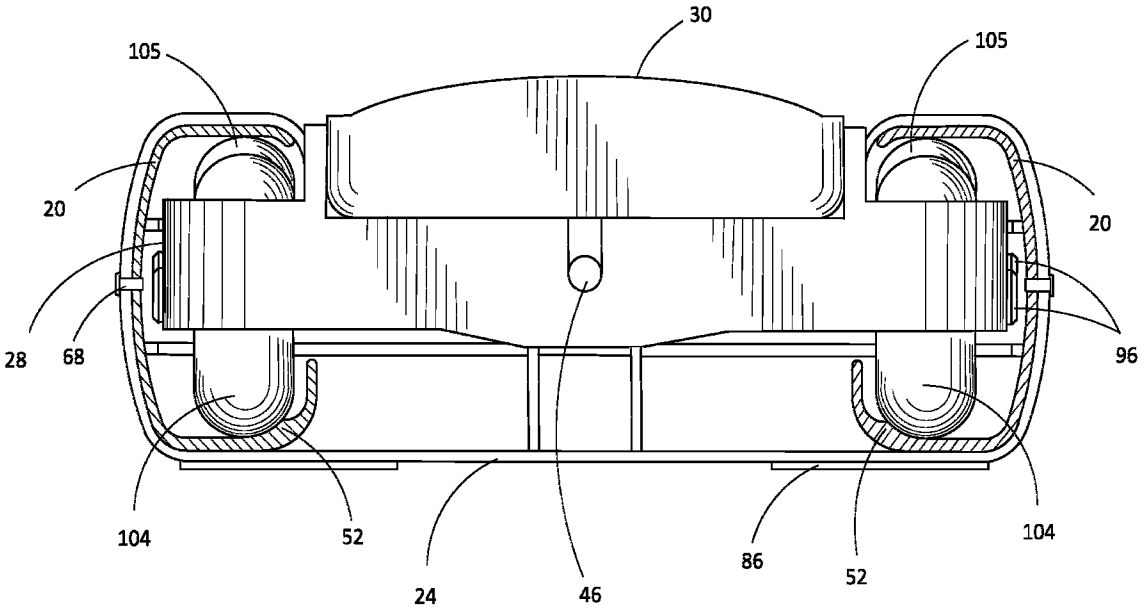
FIG. 16 is a front or rear view of a second embodiment of the housing with the end cap removed.

There are other possibilities with regard to the relative position of the top flat portion 48 of the foot support 30 with respect to the wheels 104 and 105 as illustrated in FIGS. 15 and 16, where the foot support 30 placed between the wheels. This allows the user's foot to be at a lower position than when the foot support 30 is placed above the wheels 104, but the wheels are more spread out.

Figure 17:
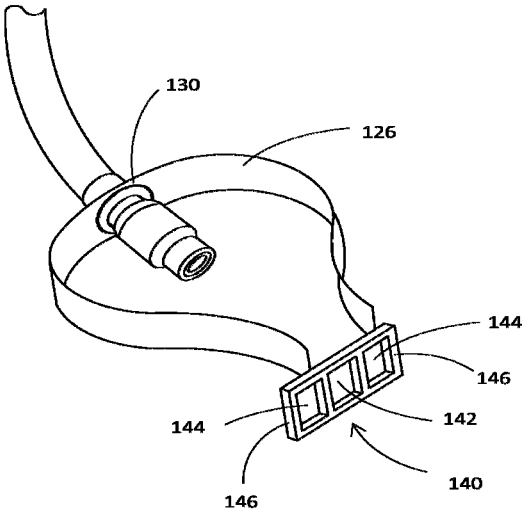
FIG. 17 is a perspective view of one embodiment of the resistance element and illustrating the buckle, strip and grommet.
Figure 18:
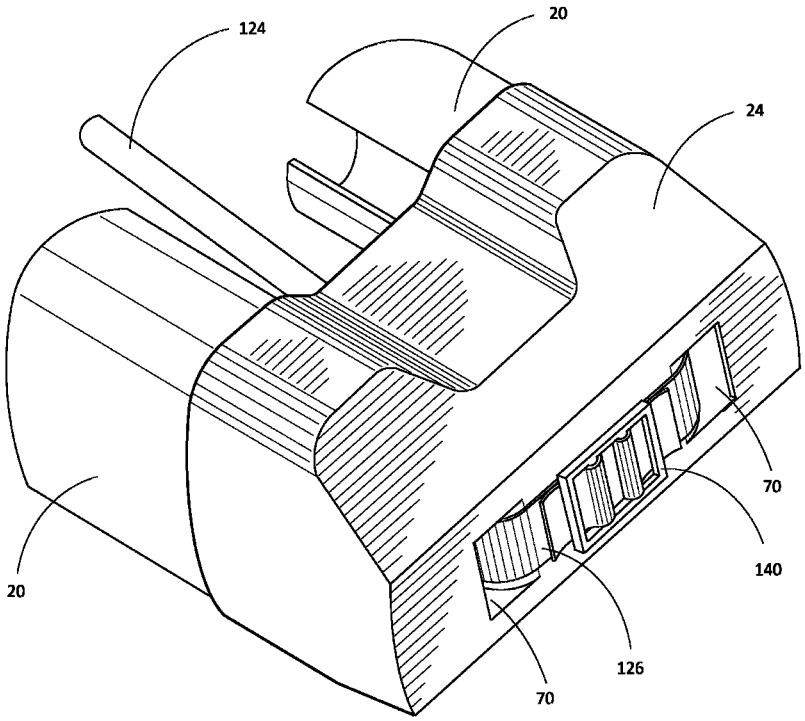
FIG. 18 is a top perspective view of one embodiment of the end cap with buckle.

An alternative embodiment with regard to securing first and second ends of the strip with each other can be, for example, releasably securing the first and second ends of the strip with a buckle. FIGS. 17 and 18 show a strip and buckle assembly configuration used to releasably secure the strip 126 to the end cap 24. The first and second ends of the strip are first threaded through the slots 70 from the inside to the outside of the end cap 24 and then threaded through the middle slot 142 of the buckle 140, looped back and threaded through the end slot 144 of the buckle 140, then inserted beneath the sides 146 respectively. As a result, the pressure of buckle against the strip prevents the strip from disengaging, thereby providing a method of releasably securing the strip to the end cap 24.

Figure 19:
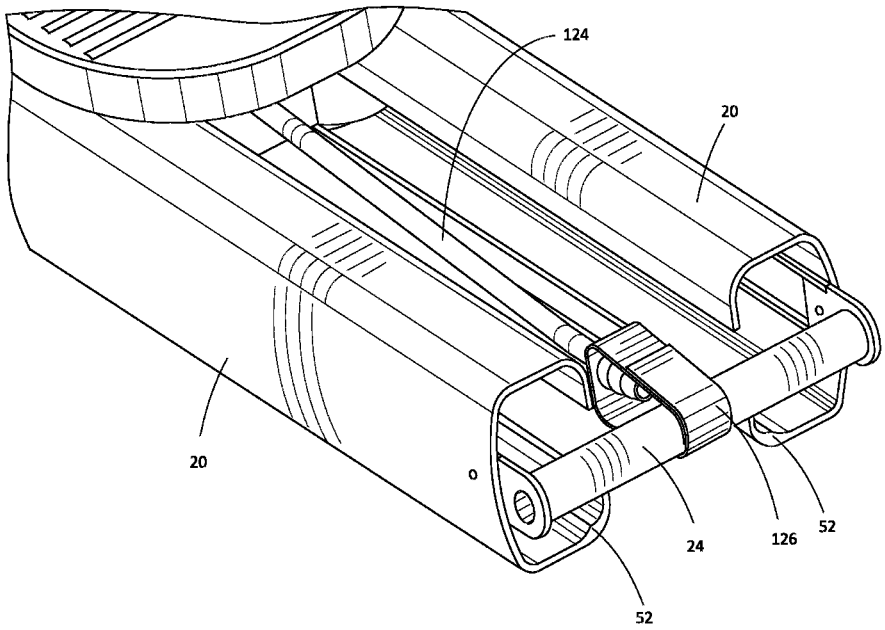
FIG. 19 is a top perspective view of a second embodiment of the end cap.

An alternative embodiment with regard to the end cap is shown in FIG. 19, where the end cap 24 comprises a transversal beam attached to a plurality of tracks. The beam is used as an anchor where both ends of strap 126 of the resistance element 26 are wrapped around the middle section of the beam.

Figure 20:
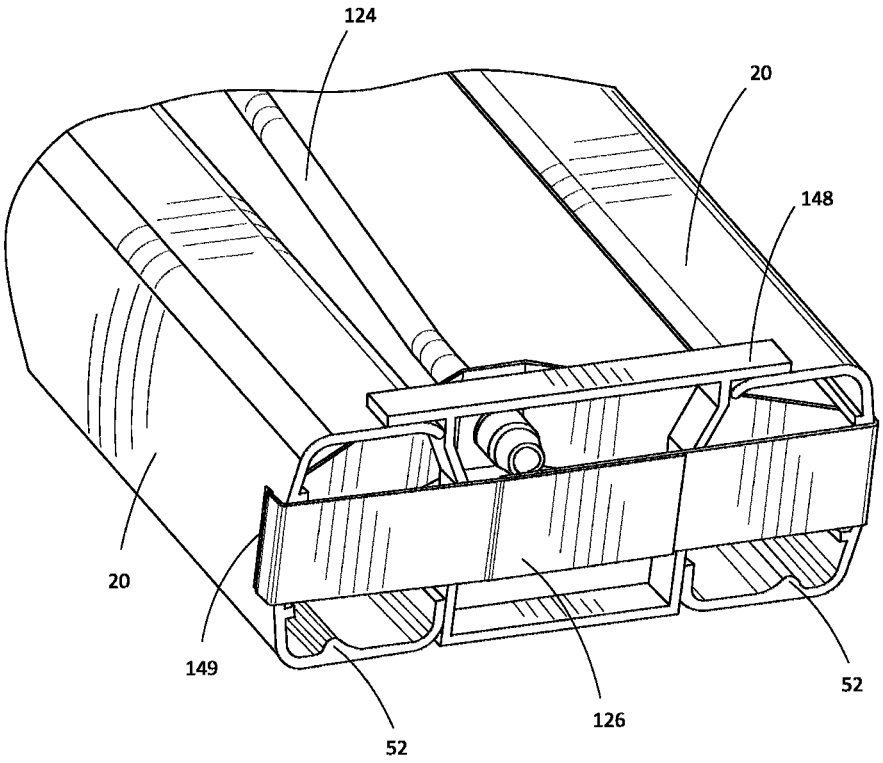
FIG. 20 is a top perspective view of one embodiment of the resistance element and a portion of the track assembly.

An alternative embodiment with regard to releasably attaching the resistance elements directly to the tracks without using end caps is shown in FIG. 20. The strip 126 is attached to the tracks by passing the first end of the strip through the slot 149 at the end of one track and passing the second end of the strip through the slot 149 at the end of the other track and then connecting the first end of the strip to the second end the strip. The tracks 20 are connected to each other by means a connector 148. In yet another embodiment (not shown), the tracks are made out of integral piece.

Figure 23:
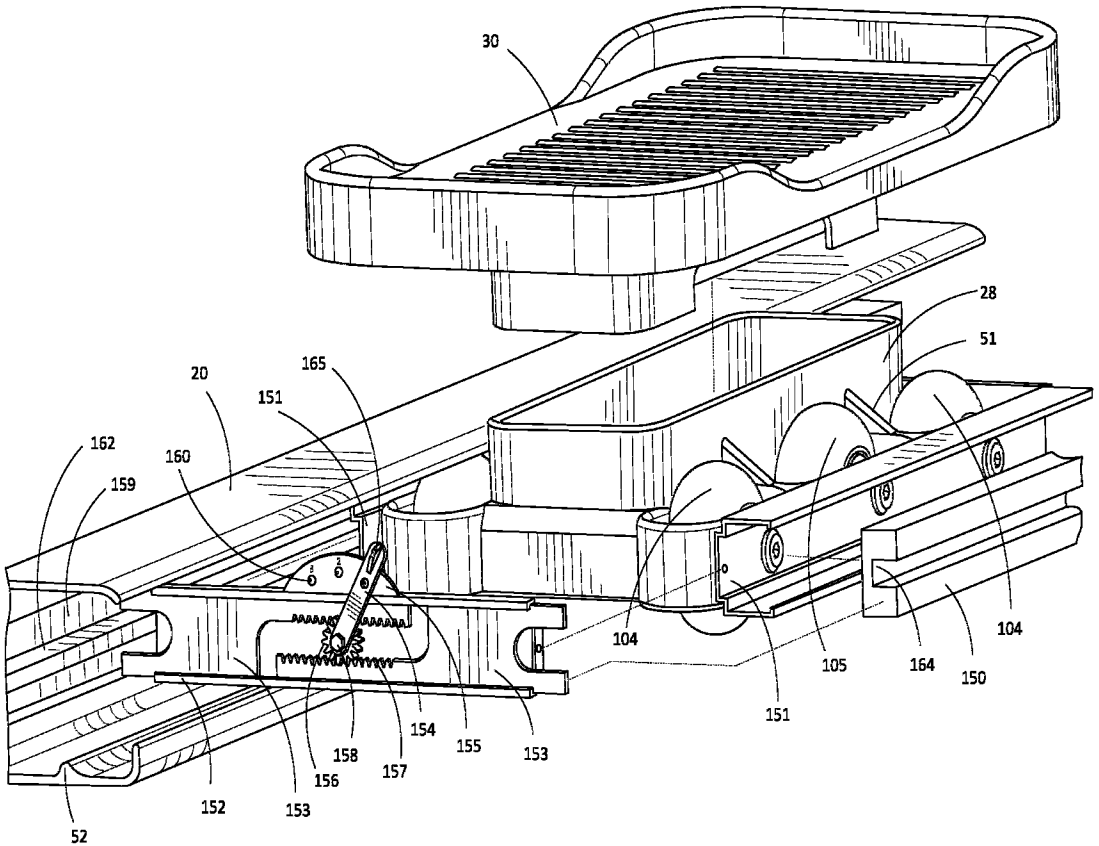
FIG. 23 is an exploded view of a second embodiment of the foot carriage with magnetic resistance element and a portion of the track assembly.

An alternative embodiment with regard to the foot carriage is shown in FIG. 23. The frame 28 may be configured to have a raised wall periphery with gussets 51 supporting the portion of the frame carrying the wheels. The foot support 30 having a wall periphery engages with the wall periphery of the frame 28 and rests on the frame.

Figure 21:
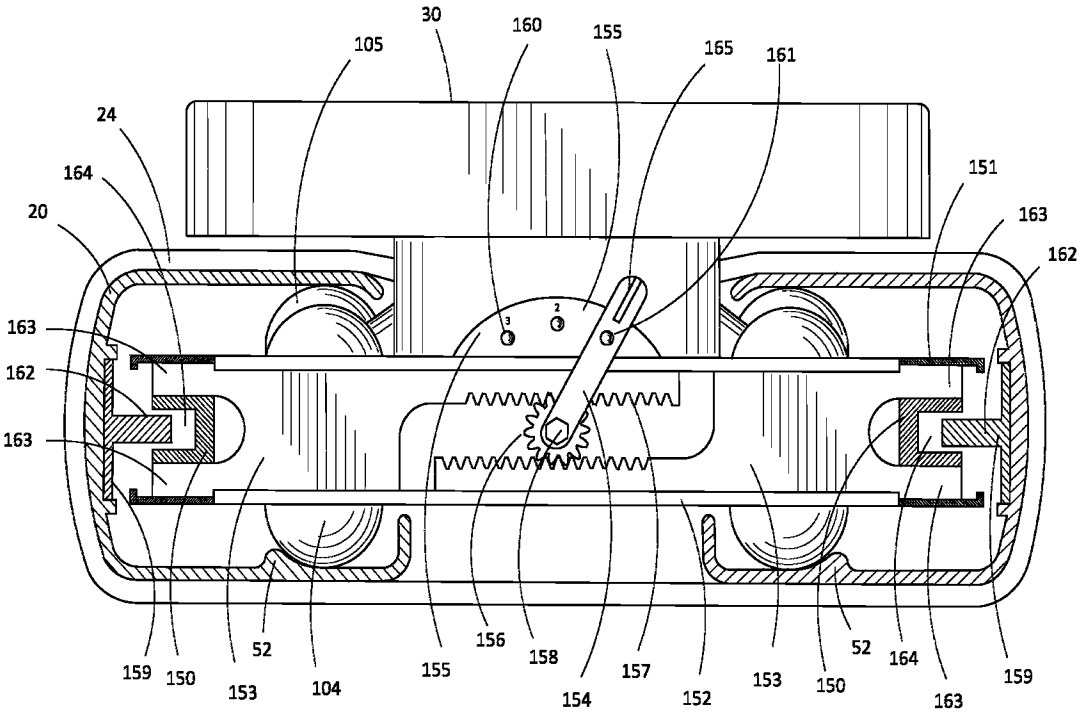
FIG. 21 is a front or rear view of a second embodiment of the housing with the end cap removed showing permanent magnets.
Figure 22:
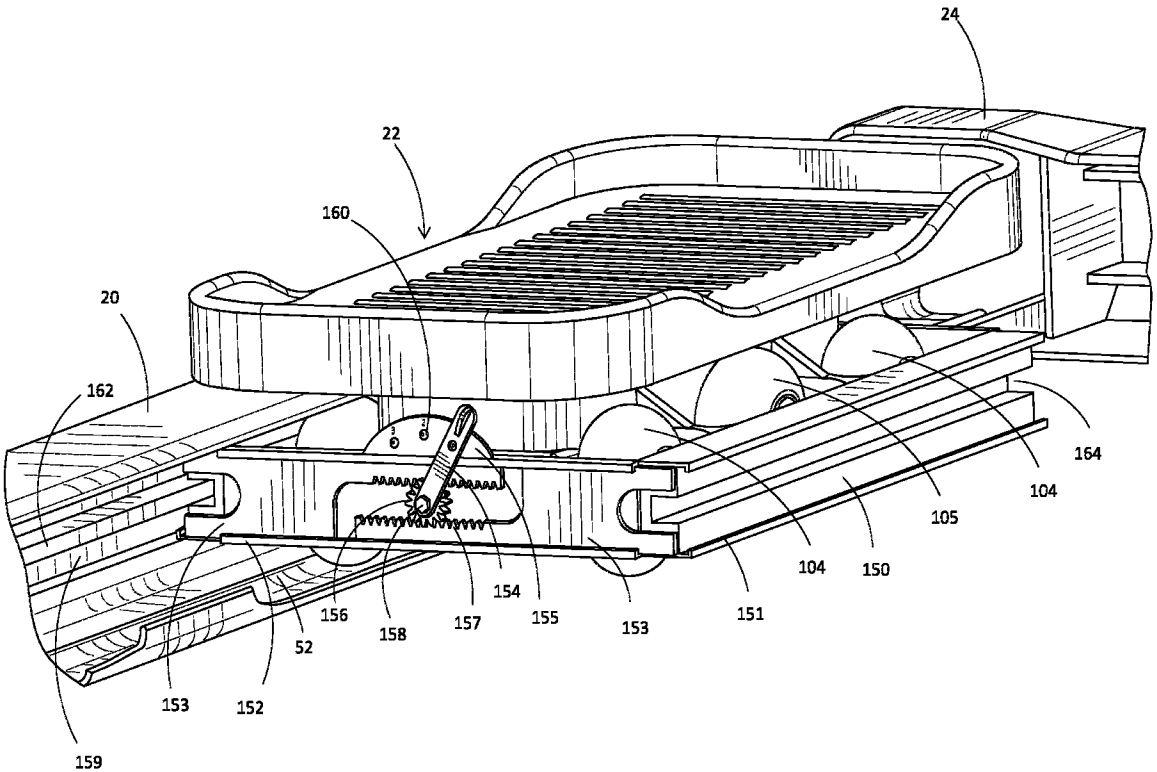
FIG. 22 is a top perspective view of a second embodiment of the foot carriage with permanent magnets and a cut-out of the track and one end cap.

An alternative embodiment with regard to the resistance element is shown in FIGS. 21, 22, and 23. A magnet holder 151 defines a channel with first and second ends and it is attached to each side of the foot carriage 22 by means of screws, rivets, bolts or other suitable means. At least one magnet 150 is located inside each magnet holder 151 and is constrained to move in the transverse direction of the foot carriage by means of magnet arms 153 which are slideably mounted inside the cross bar 152. The magnet 150 having first end and second end defines a bar with the groove 164 along the length. The cross bar 152 defines a channel that is located at the first end of the foot carriage 22 and has its first end attached to the first end of first magnet holder 151 and its second end attached to the first end of the second magnet holder 151 which is located on the other side of the foot carriage while, similarly, the second cross bar 152 located at the second end of the foot carriage 22 has its first end attached to the second end of the first magnet holder 151 and its second end attached to the second end of the second magnet holder 151. The magnet arms 153 in both the first and second ends of the foot carriage have first ends which defines two tabs 163 and second ends which define racks 157. The cross bars 152 located at both ends of the foot carriage 22 contain a pair of magnet arms 153 for which their first ends are attached to the first ends of the magnets 150 and their second ends mesh with the pinion 156. The pinion 156 defines a gear with a plurality of teeth meshing with the teeth of the rack 157 and centered at the cross bar 152. The lever 154 defines a bar with a first end used as a pivot point and attached to the pinion 156 and a second end with an opening 161 and a handle 165. The pinion and the lever are attached together and rotatably mounted at the middle of the cross bar by means of the screw 158. Using the handle 165 of the lever 154, the user can rotate the pinion 156 which drives the racks 157, thereby moving the magnet arms 153 closer or far apart. The dial defines a plate attached to the cross bar and having a plurality of bosses along an arc centered on the pinion 156 axis. Each boss represents a resistance level for which the lever 154 is rotated to vary the magnetic resistance and causes the opening 161 on the lever to snap and lock on the boss 160, thereby, maintaining a distance of the magnet 150 from the reaction element 159. The reaction element 159 defines a beam that is attached to the tracks 20 and having a flange 162 that extends along the length of the tracks. The flange 162 is slideably located inside the magnet groove 164 for which the magnets move transversally by means of the magnet arms and longitudinally by means the foot carriage 22. The magnetic resistance works when the user moves the foot carriage 22, thereby moving the magnet over the flange 162 which passes through the magnetic field set up the magnet 150. The amount of resistance can be increased or decreased by varying the strength of the magnetic force which is controlled by changing the distance or the gap between the magnet 150 and the flange 162. The distance between the magnet 150 and the flange 162 varies with the transverse displacement of the magnet 150 toward or away from the flange 162.

Figure 24:
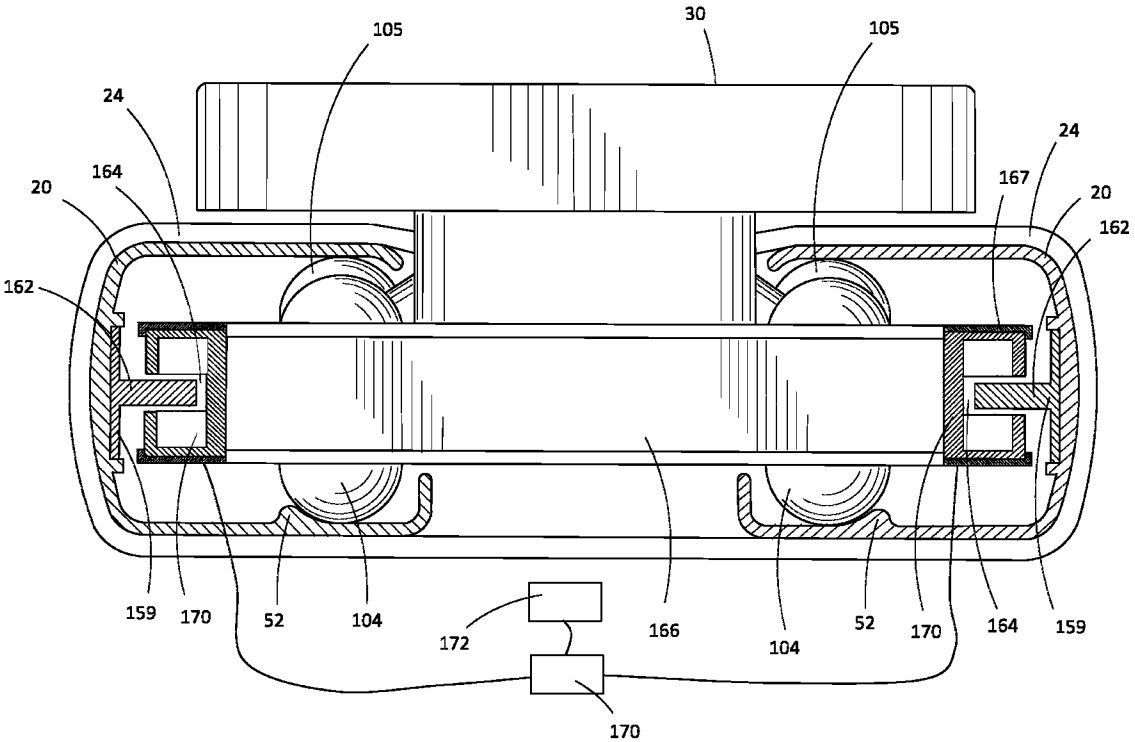
FIG. 24 is a front or rear view of a third embodiment of the housing with the end cap removed showing electro magnets.
Figure 25:
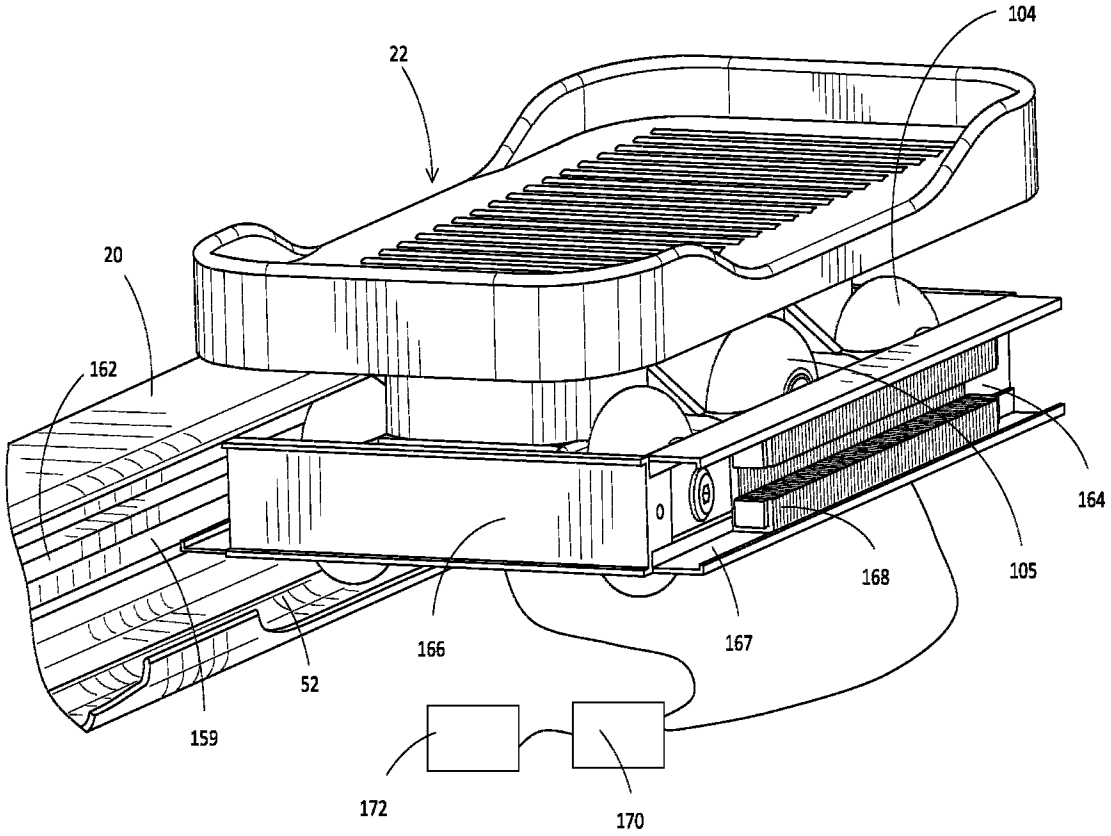
FIG. 25 is an exploded view of a third embodiment of the foot carriage with electro magnets and a portion of the track assembly.
Figure 26:
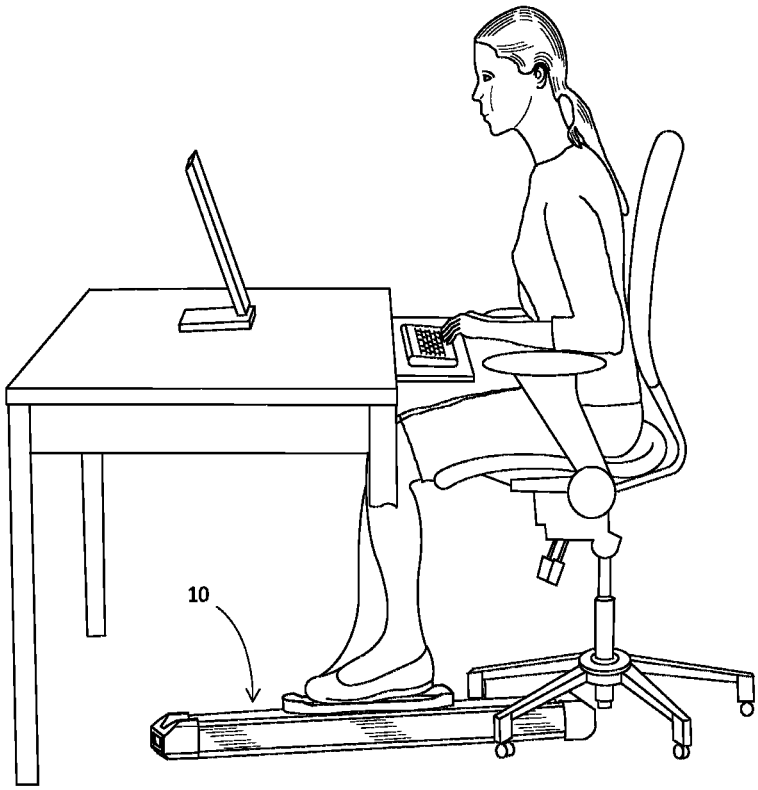
FIG. 26 is a perspective view illustrating a user sitting and using the exercise device.

An alternative embodiment with regard to the resistance elements is shown in FIGS. 24, and 25 where the magnet holder 167 defines a channel and is attached to each side of the foot carriage 22 by means of screws. A plurality of electro magnets 168 are located and fixed inside the magnet holders 167. The cross bar 166 defines a beam located at the first end of the foot carriage 22 has its first end attached to the first end of magnet holder 167 and its second end attached to the first end of the magnet holder 167 on the other side of the foot carriage while, similarly, the second cross bar 166 located at the second end of the foot carriage 22 has its first end attached to second end of magnet holder 167 and its second end attached to the second end of the other magnet holder 167. A circuit board 170 is electrically connected to the electro magnets 168 and a control device 172 connected to the circuit board 170. The gap between the magnet 168 and the reaction element 159 is fixed but the user may operate the control device 172 to adjust the current supplying the electro magnets 168 so as to vary magnetic force, thereby changing the resistance to the moving foot carriage.

The exercise device 10 can be used in connection with working the lower body by stimulating the large muscles of the body, particularly those in the legs. The device of the present invention is portable, simple and can be placed under a desk in an office or used when sitting on a sofa and watching TV. FIG. 18, for example, illustrates a user sitting in front of a computer screen and moving the foot in forward and backward motion. Thereby, allowing the lower body to exercise without subjecting the joints to impacts thus avoiding potential joint pains. The user can apply the foot against the foot support 30 and move the foot carriage 22 forward pulling the rear elastic tube 124, thereby creating resistance to forward motion. When the user moves the foot carriage backward causing the front elastic tube 124 to stretch and provides resistance opposing the force exerted by the user. The elastic tubes 124 can be removed easily from the device by disengaging the foot support 30 from frame 28 and unfastening the strip 126 from the end cap, thereby, allowing the user to have the option of easily installing elastic tubes with low to heavy resistance or using the device without resistance. Alternatively, the resistance can be magnetic and adjusted by using the mechanism to move the magnets closer or away from the reaction plates or in case of electro magnets, the resistance can be adjusted by means of changing the electrical current through the control device. The user has the option to use one device to alternate between two legs to exercise one leg only at one time or use two devices to exercise two legs simultaneously and independently.

While the preferred embodiment of the invention has been illustrated and described, it will be appreciated that various changes, adaptations and modifications may be made therein without departing from the spirit of the invention.

I claim:

1. An exercise device, comprising:

a) a track assembly comprising a plurality of tracks each having a first end, a second end, and a length, where the tracks are held parallel to one another;

b) a foot carriage with a first and second end having a plurality of wheels mounted thereto in such a manner as to enable said foot carriage to roll along said track assembly, where the first end of the foot carriage is in proximity to the first end of the track assembly and the second end of the foot carriage is in proximity to the second end of the track assembly; and c) a plurality of resistance elements which impede the movement of the foot carriage along the track assembly;

where the foot carriage comprises a frame and a foot support; and where the foot support is slidably removable from the frame.

2. The exercise device of claim 1 in which the tracks are held parallel to one another by an end cap on each end of the tracks, which end caps enclose the ends of the tracks.

3. The exercise device of claim 1 in which the tracks are held parallel to one another by a plurality of connectors located at the ends of the tracks.

4. The exercise device of claim 1 in which the track assembly is made out of one integral piece comprising a plurality of tracks.

5. The exercise device of claim 1 in which the resistance elements which impede the movement of the foot carriage along the track assembly each have a first end and a second end, and where the first resistance element has its first end releasably attached to the first end of the track assembly and its second end releasably attached to the first end of the foot carriage, and where a second resistance element has its first end releasably attached to the second end of the track assembly and its second end releasably attached to the second end of the foot carriage.

6. The exercise device of claim 1, where in the frame comprises walls, wherein the wheels are mounted within the walls of the frame, wherein said tracks define channels, and in which the wheels mounted within the walls of the frame can travel.

7. The exercise device of claim 6, in which a plurality of the wheels are disposed to travel along the lower portion of the surface of the interior of the channel.

8. The exercise device of claim 6, in which a plurality of the wheels are disposed to travel along the upper portion of the surface of the interior of the channel.

9. The exercise device of claim 6, wherein at least one longitudinal ridge extends along the interior of the channels.

10. The exercise device of claim 1, wherein said frame comprises a structure for slidably receiving and holding said foot support and for carrying a plurality of wheels.

11. The exercise device of claim 1, wherein said foot support comprises a top portion in the form of a flat surface shaped to receive the user's foot and a bottom structure having a front and a rear end; wherein the bottom structure is configured for engaging with said frame; where the bottom structure has open slots disposed on both the front end and the rear end; and where when the bottom structure is engaged with the frame, the frame and the bottom structure combine to define a hole at each of the first end and the second end of the foot carriage assembly.

12. The exercise device of claim 1, wherein the frame comprises walls, wherein said foot carriage carries axles on which are rotatably mounted said plurality of wheels within the walls of said frame of the foot carriage assembly.

13. The exercise device of claim 1, wherein said resistance elements comprise elastic tubes that each have a first end and a second end and where a washer encircles each of the second ends of the elastic tubes, and where a plug is disposed adjacent to the washer and within the channel defined by the tubes toward the second end of the tubes, releasably securing the washer to the elastic tubes.

14. The exercise device of claim 1, wherein said resistance elements comprise a plurality of strips each having a hole disposed in the center of the strip, where the first end of each of the elastic tubes extends through the hole disposed within the center of the strip and where the strip has a first end and a second end which are releasably securable to each other.

15. The exercise device of claim 14 where a plug is disposed adjacent to the strip and within the channel defined by the tubes and toward the terminus of the tubes, releasably securing the strip to the elastic tubes.

16. The exercise device of claim 15, wherein said strip has a grommet disposed about said hole, and where the grommet has an inside diameter less than the outside diameter of the plug that is disposed within the channel at the first end of the elastic tube.

17. The exercise device of claim 13, wherein said washer defines a hole and where the diameter of said hole is less than the outside diameter of said plug.

18. The exercise device of claim 13, wherein said elastic tubes include sleeves disposed about the portions of the second ends of said elastic tubes that extend through the hole of said washer.

19. The exercise device of claim 14, wherein said elastic tubes include sleeves disposed about the portions of the first ends of said elastic tubes that extend through the hole of said strip.

20. The exercise device of claim 13, wherein the foot carriage has openings disposed in the front and rear portions of it, which openings are dimensioned so that the washer cannot fit through the hole.

21. The exercise device of claim 20, wherein each of the second ends of said resistance elements extends through the one of the holes from the exterior of the foot carriage to the interior in such a way that the plugs and washers are held in the interior portion of the foot carriage while the first end is on the exterior portion of the foot carriage.

22. The exercise device of claim 2, where the end cap has a plurality of slots disposed on the end cap for releasably securing the plurality of resistance elements.

23. The exercise device of claim 14, wherein said first and second ends of the strip releasably secure to each other by means hook and loop fasteners.

24. The exercise device of claim 14, wherein said first and second ends of the strip releasably secure to each other by means of a buckle.

25. The exercise device of claim 1 further comprising at least one pad of non-slip material secured to the bottom portion of the exercise device.

26. The exercise device of claim 1 in which the resistance elements comprise a plurality of magnets, a plurality of reaction plates attached to the track assembly, and at least one magnet holders, each with a first end and a second end where at least one magnet holder is attached to the foot carriage.

27. The exercise device of claim 26, wherein said resistance elements have at least one cross bar with a first end and a second end located at the first end of the foot carriage where the cross bar has its first end attached to the first end of the first magnet holder and its second end attached to the first end of the second magnet holder and where at least one cross bar located at the second end of the foot carriage and has its first end attached to second end of the first magnet holder and its second end attached to the second end of the second magnet holder.

28. The exercise device of claim 26, wherein said magnets have a longitudinal groove along their lengths.

29. The exercise device of claim 27, wherein said cross bar contains a pair of magnet arms for which their first ends define tabs capable of being attached to the ends of the magnets and their second ends define racks meshing with a pinion that is rotatably mounted to the cross bar.

30. The exercise device of claim 29, wherein said resistance elements comprise further a lever which having a first end attached to the pinion and used as a pivot point and an opening at a distance from the first end.

31. The exercise device of claim 30, wherein said resistance device comprises further a dial attached to the cross bar and defines a plate having a plurality of bosses along an arc centered at the pinion axis where the bosses are situated in a location such that they can fit into the opening in the lever to lock the mechanism into a particular position.

32. The exercise device of claim 1 in which the resistance elements comprise at least one electro-magnet attached to magnet holders and having longitudinal grooves in which reaction plates are slideably located without contact.

33. The exercise device of claim 32, wherein said resistance elements comprises a circuit board electrically connected to the electro-magnets and a control device connected to the circuit board.

34. The exercise device of claim 1, wherein the frame further comprises a peripheral wall extending around the periphery of the frame, wherein the frame comprises a plurality of subsidiary walls, wherein the plurality of subsidiary walls and the peripheral wall combine to define a plurality of apertures, and wherein each of the wheels are mounted within an aperture.

35. The exercise device of claim 2, wherein said end cap comprising a housing with a wall thickness and a plurality of ribs and having side, bottom and top panels where the tracks are attached to the inside surface of the end cap.

36. The exercise device of claim 1, wherein said frame having raised wall periphery with gussets supporting the portion of the frame structure with said apertures where the wheels are mounted.

* * * * *